US005890365A

United States Patent [19]

Sisti

[11] Patent Number: 5,890,365

[45] **Date of Patent: *Apr. 6, 1999**

[54] INTERNAL COMBUSTION ENGINE CONSTANT SPEED VARIABLE VOLUME COUPLING AND OPERATION PROCESS

[76] Inventor: Leonard A. Sisti, 8169 Spanish Oak Dr., Spring Hill, Fla. 34606

[ * ] Notice: The terminal 35 months of this patent has been disclaimed.

[21] Appl. No.: 93,589

[22] Filed: Jul. 19, 1993

[51] Int. Cl.[6] ..... F01B 21/02

[52] U.S. Cl. ..... 60/709; 60/701; 60/702; 123/DIG. 8

[58] Field of Search ..... 123/DIG. 8; 60/709, 60/701, 702, 698

[56] References Cited

U.S. PATENT DOCUMENTS

| | | | |
|---|---|---|---|
| 3,852,963 | 12/1974 | Hufstader | 123/DIG. 8 |
| 4,116,006 | 9/1978 | Wallis | 60/709 |
| 4,417,551 | 11/1983 | Kronogård et al. | 123/DIG. 8 |
| 4,421,217 | 12/1983 | Vagras | 60/709 |
| 4,512,301 | 4/1985 | Yamakawa | 123/DIG. 8 |
| 4,632,081 | 12/1986 | Giuliani et al. | 123/DIG. 8 |
| 4,638,637 | 1/1987 | Kronogård et al. | 123/DIG. 8 |
| 4,935,689 | 6/1990 | Fujikawa et al. | 123/DIG. 8 |

FOREIGN PATENT DOCUMENTS

| | | | |
|---|---|---|---|
| 2491147 | 4/1982 | France | 123/DIG. 8 |
| 2828298 | 1/1980 | Germany | 60/709 |
| 3245361 | 8/1984 | Germany | 123/DIG. 8 |
| 3705045 | 9/1988 | Germany | 123/DIG. 8 |
| 44733 | 3/1982 | Japan | 60/709 |

*Primary Examiner*—Ira S. Lazarus
*Assistant Examiner*—L. Heyman

[57] ABSTRACT

A self-contained, hydraulically operated clutch-type coupling, allowing a minimum of two vehicular type internal combustion engines to be mounted in tandem replacing the standard single block, multi cylinder engine. Flexibility is provided to the driver by a computerized control system to select operation of one or more engines to produce minimum to maximum horsepower at the flywheel, necessary to meet specific road and traffic conditions while maintaining a constant engine (RPM) speed. In one embodiment, a single engine is started to minimize undesirable emissions due to the combination of cold start conditions and wall quenching and fuel conservation purposes. Upon attaining engine operating temperature uniformity, the succeeding engine(s) can be started and operated to provide maximum available horsepower/torque to meet road load conditions. A second embodiment includes primary engine standard throttle linkage providing an input signal to the computer controlling total engine (RPM) speed by means of a stepper motor driving the secondary engine throttle linkage after synchronization of the two or more engines is attained and monitored by crankshaft sensor and tachometer input to the computer.

6 Claims, 8 Drawing Sheets

K13-K13

K14-K14

INTERNAL COMBUSTION ENGINE CONSTANT SPEED VARIABLE VOLUME COUPLING AND OPERATION PROCESS

FIELD OF INVENTION

This invention relates to the vehicular multi-cylinder internal combustion engine. More specifically this invention addresses the coupling of two or more internal combustion engines in tandem to provide on demand engine speed and volume control.

BACKGROUND

Heretofore, internal combustion engines have been manufactured based on a constant speed/fixed volume design in that the engine speed in revolutions per minute (RPM) and piston displacement are the major factors in determining horsepower and torque delivered at the flywheel. The final delivered horsepower/torque requirement necessary for a particular application is established to satisfy anticipated road load conditions consisting of (a) rolling resistance, (b) air resistance, (c) vehicular gross weight and (d) road grade.

Road Horsepower is expressed by the formula:

$$\frac{V[Cr\,W + Ca\,AV^2 + 0.01\,GW]}{375}$$

Where:

Cr=Coefficient of Rolling Resistance

Ca=Coefficient of Air Resistance

V=Vehicle speed, MPH

A=Frontal area in square feet

W=Gross Weight in pounds

G=Road Grade, percent

Predicated on the assumed requirements, a final design for a specific single block of four, six, eight or more cylinders is produced for installation in a variety of production type vehicles. Since the engine design and selection is based on a variety of assumed conditions, it is in most cases oversized for the greater percentage of use normally encountered.

Air pollution contributed by vehicle emissions includes Hydrocarbons (HC), Carbon Monoxide (CO), Oxides of Nitrogen (NO), Oxides of Sulfur (SO2) and Particulate Matter. Of the total Hydrocarbon Emissions from uncontrolled vehicle engines, 20 to 25 percent is caused by crankcase blow-by, 60 percent of the undesirable exhaust emissions are formed mainly within the combustion chamber of the engine during or after the combustion process and appear in the exhaust. The remainder of the emissions are contributed to evaporative losses.

In a four cycle, water cooled engine "wall quenching" is the predominate source of exhaust hydrocarbons. Wall quenching is a combustion phenomena that arises when a flame attempts to propagate in the vicinity of a surface or wall. Normally the effect of the wall is a slowing down or stopping of the reaction. In general, wall quenching results from both the chain breaking of the chemical reactions of the fuel/air mixture and from the cooling of the layer of charge adjacent to the wall (which is cooler than the rest of the combustion chamber). As a result the flame will not propagate completely to the wall surface. Wall quenching is the principal source of unburned hydrocarbons in the exhaust of an engine under most normal conditions and is extremely high during cold start conditions.

Of course hydrocarbons present a serious environmental concern. At a level of 0.15 parts per million (ppm) oxidant, approximately 50 percent of the population experience some eye watering. Further, a reduction of nitrogen oxide first increases then decreases smog products; therefore, nitrogen oxide and hydrocarbons together should be reduced to virtually zero before a smog benefit is realized.

To date state of the art engines are fixed volume in design. Due to the single block multi-cylinder vehicle engines presently in use, petroleum base fuels are used uneconomically during periods of cold starting, heavy traffic (when engine idling and extremely slow speeds are encountered) and at cruising speeds when road conditions, rolling resistance, air resistance and grade do not require full design horsepower. In recent years due to Federal mandates, automotive manufacturers have developed and placed in use a variety of emission control systems. These systems along with the electronic ignition, fuel injection and the use of unleaded fuel have contributed greatly to the decrease of exhaust and evaporative emissions, but have not reached the emission standard goals projected for the future. Also, these emission control systems, which are add-on in nature, have further contributed to the inefficient use of gasoline fuels.

Based on information available in the "1991 Gas Mileage Guide, EPA Fuel Economy Estimates, October 1990, DOE/CE-0019/10", the average mileage (miles per gallon) for passenger type automobiles manufactured in the United States is 18.14 MPG city and 24.64 MPG highway. The current practice within the automotive manufacturing industry of utilizing a single block multi-cylinder engine based on the constant speed/fixed volume concept continues to contribute now and into the future to excessive air pollution and the inefficient use of petroleum base fuels.

OBJECTS OF THE INVENTION

The purpose of the invention is to provide a practical means of coupling and controlling two or more vehicular type internal combustion engines, or to couple multiple internal combustion chambers in such a way as to allow an effective increase in combustion volume upon need or demand. This will make available the choice of more than one horsepower curve at the flywheel by selecting the engine volume necessary for a specific driving condition.

The advantages of this invention are:

First, the designer/manufacturer will no longer be required to make assumptions during design of a specific engine to cover all possible driving conditions in a single block multi-cylinder engine and arrive at a single optimal horsepower curve. Instead this invention affords the availability of two or more specific horsepower/torque curves at the flywheel to economically adapt to a variety of road and driving conditions.

Second, the invention will substantially reduce the amount of hydrocarbon emissions in the exhaust due to wall quenching during cold starts and normal operating conditions.

Third, the invention will drastically reduce hydrocarbon and nitrogen oxide emissions together therefor decreasing smog products.

Fourth, the invention will provide improved economic use of petroleum base fuels increasing the mileage (MPG) due to the flexibility of allowing the operator to select the engine volume required to meet specific conditions re: gross-load, heavy traffic, idling, cruising speeds, road grade and air resistance.

Fifth, by incorporating the invention with existing add on emission controls a reduction in harmful emissions and increased fuel economy of approximately 33 percent based on normal driving patterns and speed limits will result.

Sixth, additional flexibility and economy will be realized during manufacturing providing reduced cost of the final product.

Further objects and advantages of the invention will become apparent from a consideration of the drawings and ensuing description of it.

SUMMARY OF THE INVENTION

Figure 1:
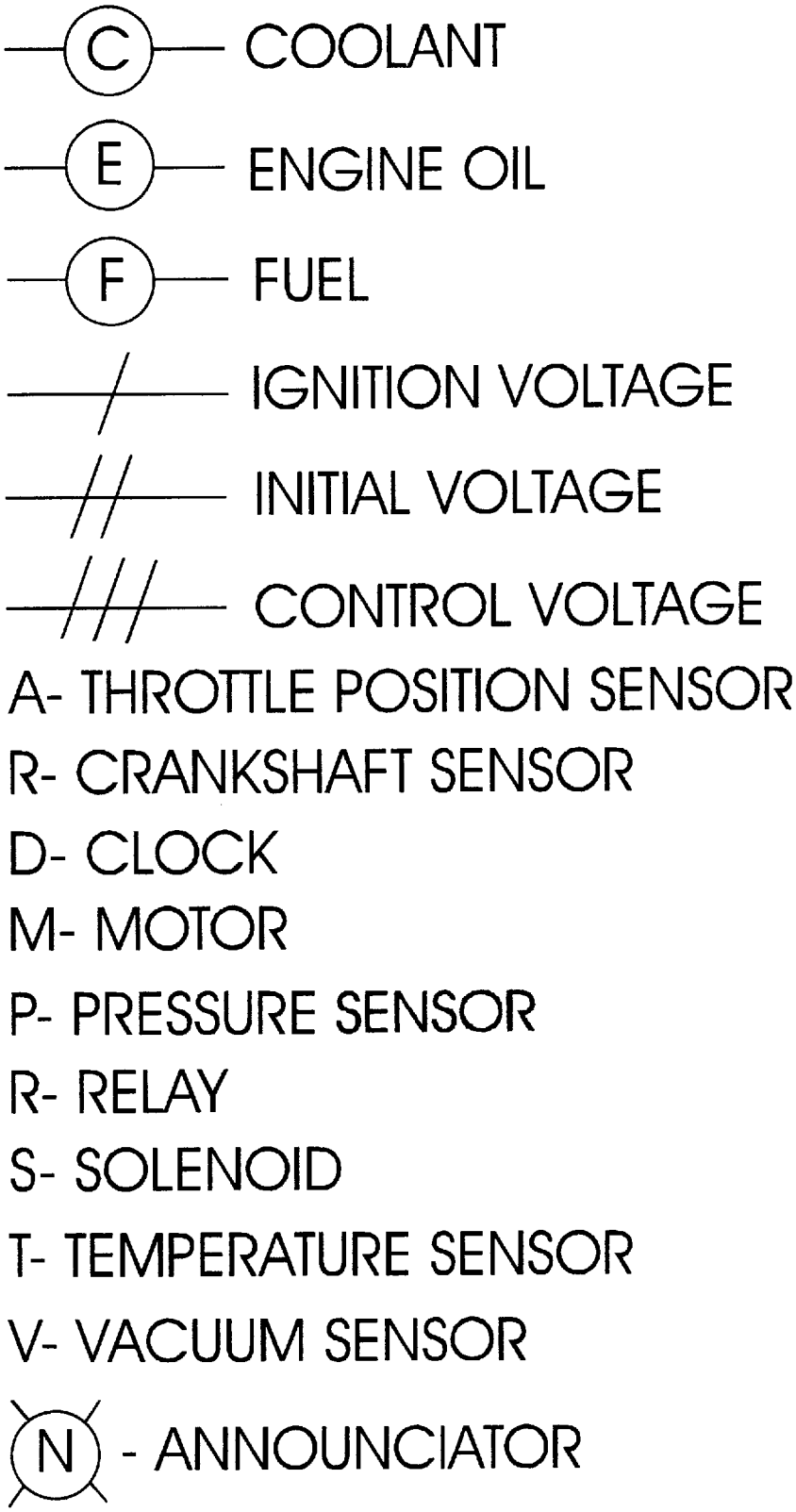
FIG. 1 is a table of symbols used in the various other Figures.

The invention relates to a constant speed, variable volume coupling device comprising: a primary engine crankshaft adaptor; a secondary engine crankshaft adaptor; and an engageable clutch means which when engaged transmit engine power between said primary engine crankshaft adaptor and said secondary engine crankshaft adaptor. In operation of the invention, the primary engine crankshaft adaptor is connected to a primary internal combustion engine and the secondary engine crankshaft adaptor is connected to a secondary internal combustion engine. The invention allows operation of a vehicle on the optimal power curve of an engine or engines, by using only the power required under the actual conditions being experienced by the vehicle at a given time. For instance, under light loads the vehicle will employ only the primary engine. The secondary engine will not be employed and hence will not move its crankshaft.

The device may be employed with any nature of internal combustion engines or a combination of different types of internal combustion engines. For instance a combination of water cooled, four stroke engines could be employed, as is described in the detailed description. The actual combination employed would depend upon the load characteristics the vehicle being designed would likely encounter.

Furthermore, the invention could be employed with more than two internal combustion engines. For example, three internal combustion engines could be linked together by employing two examples of the invention between the three engines. Specifically, one would configure a mechanical assembly comprising in seriatim: a primary engine; a primary clutch coupling; a secondary engine; a secondary clutch coupling; and a tertiary engine.

While the preferred means for accomplishing the invention is envisioned to be accomplished by use of pressure plate assembly dutch mechanisms, the invention may employ other forms of clutch means as are known to those skilled in the art. It should also be understood that the invention may use other control mechanisms than the particular control scheme illustrated in this specification. For instance, while the specification describes a mechanism for the driver choosing when the secondary, or tertiary engine, would be engaged by the constant speed, variable volume coupling. It should be recognized that the computer could control when the secondary engine was employed based upon load on the primary engine, grade of road, or other factors.

DETAILED DESCRIPTION OF THE INVENTION

In the following description I have intentionally departed from the conventional practice of numbering the internal combustion engine cylinders from front to rear. Whereas with the invention the cylinder numbering has been reversed with cylinder No. 1 located at the output end of the primary engine and proceeding forward through the secondary engine. It should also be noted that the common term primary voltage indicating the battery voltage available has been replaced with the term Initial Voltage, also the term secondary voltage indicating high voltage produced at the ignition coil has been replaced by the term Ignition Voltage.

The following component description number system is used to simplify location of a specific component:

100–199 Primary engine components

200–299 Secondary engine components

300–399 Common components

400–599 CSVV coupling mechanical components

600–699 Electrical and electronic components

Figure 3A:
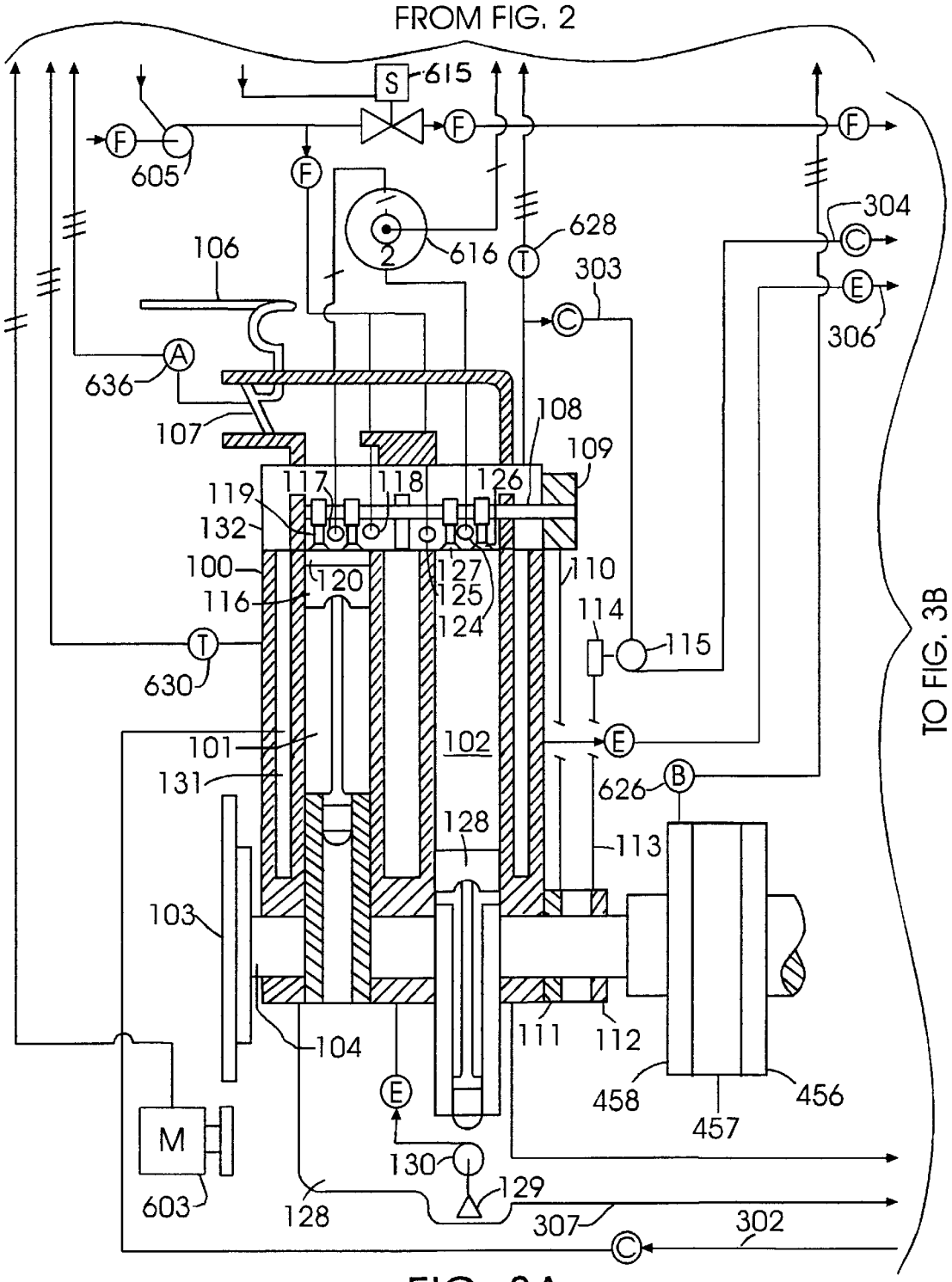
FIG. 3A is a diagram of the primary internal combustion engine and its interrelationship with the CSVV and primary internal combustion engine.
Figure 3B:
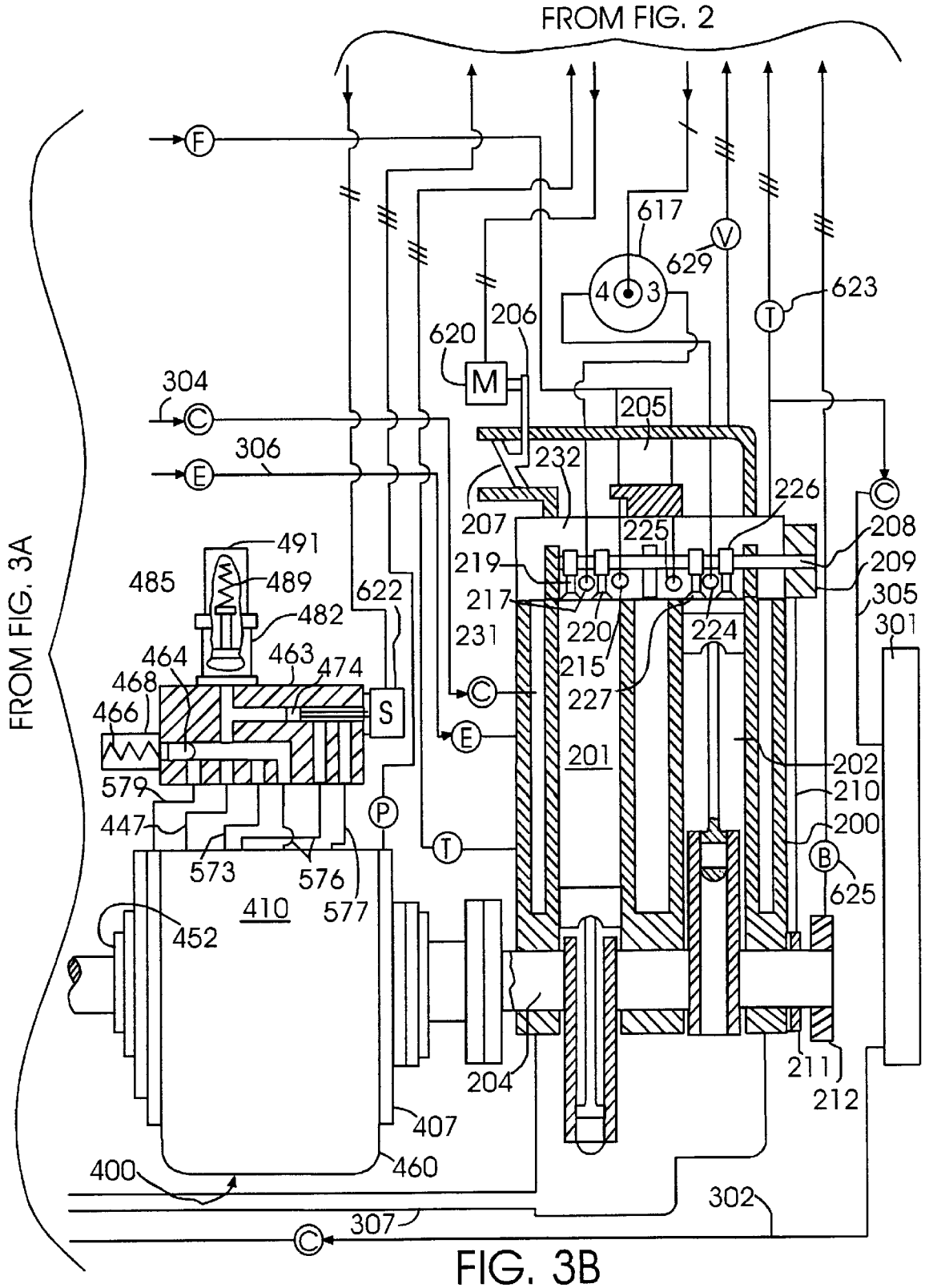
FIG. 3B is a diagram of the CSVV and the secondary internal combustion engine and interrelationship with the electronic control system and the secondary internal combustion engine of the present invention, the CSVV is here represented as a block diagram.

One particular embodiment is hereafter described. With reference to FIGS. 3A and 3B, the constant speed variable volume coupling 400 hereinafter "CSVV", an electronically controlled, hydraulically operated multiple disc dutch, is located between a primary engine 100 and a secondary engine 200. The CSVV coupling 400 is connected to a primary engine crankshaft 104 by means of a primary engine crankshaft adaptor half coupling 458, a primary engine crankshaft adaptor spacer 457 and a primary engine crankshaft adaptor 456.

Figure 4:
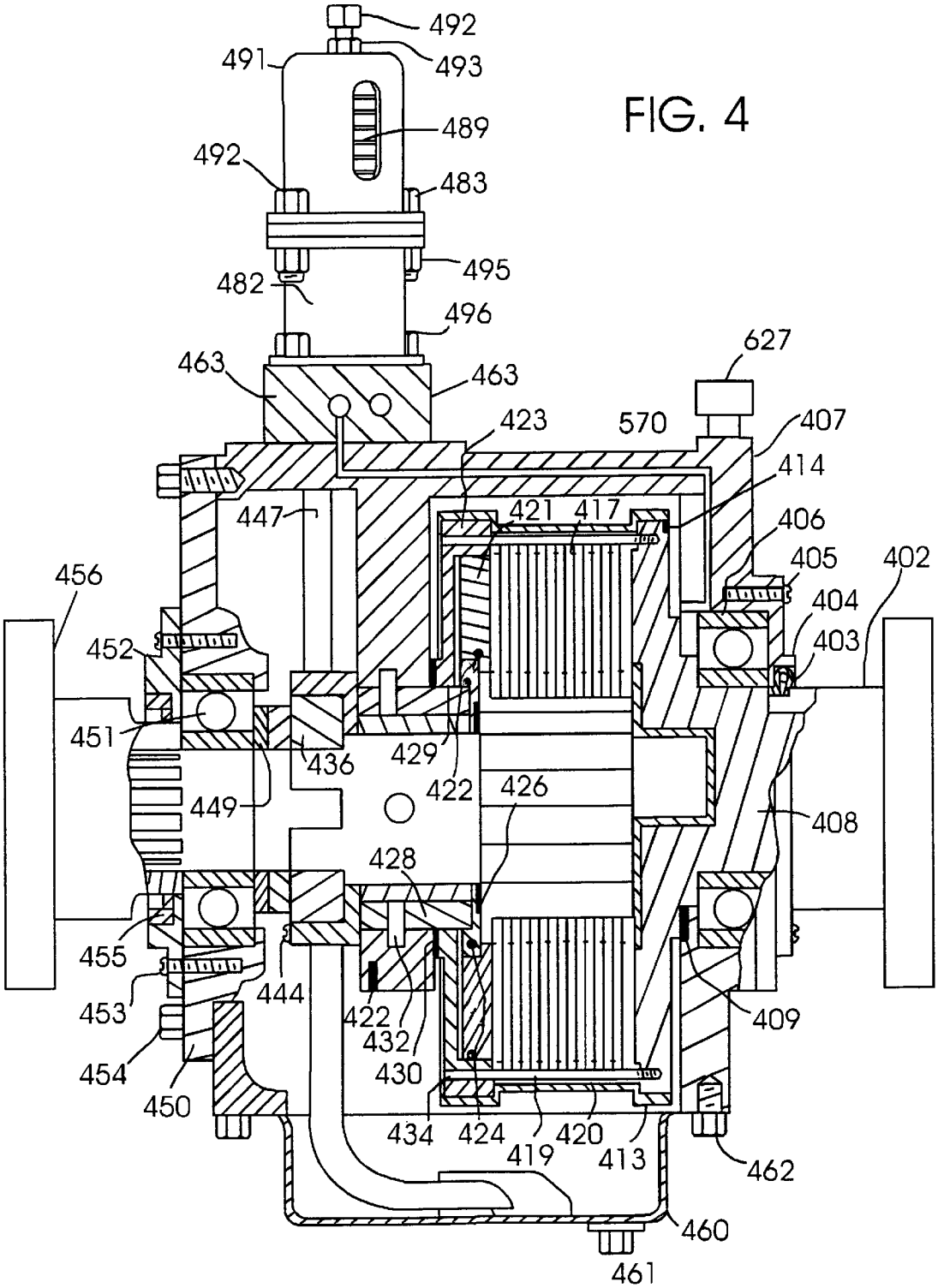
FIG. 4 is a detailed cross-section of one embodiment of the constant speed variable volume coupling (CSVV) of the present invention including the accumulator assembly.

The CSVV coupling 400, FIG. 3*b* and FIG. 4, is connected to the secondary engine crankshaft 204 by a secondary engine crankshaft adaptor 402. The case 410 further comprises a front bearing oil passage 570, a rotating members lubrication oil passage 573 and a hydraulic pressure passage 576. The multiple disc clutch located within the case 410, FIG. 4, comprises a clutch drum front closure 408 secured to a clutch drum 413 by a snap ring 414. The dutch drum annular piston return spring guides 419 are threaded into the front closure 408 and the clutch drum annular piston return springs 420 slide over the spring guide 419. The clutch discs 416 and clutch plates 417 are installed in alternating order in the drum 413.

An annular piston seal "O" ring 422 is provided on the annular piston 421. A dutch drum piston seal "O" ring 424 is installed on the hub of the clutch disc rear closure 423 and the annular piston 421 inserted into the drum rear closure 423. The primary engine drive spline 425 is then inserted into the dutch disc 416, dutch plate 417 assembly into the front closure bushing 415. The dutch drum rear closure thrust washer 426 is positioned on the drive spline 425 followed by installing the drum rear closure 423, annular piston 421 assembly onto the drive spline 425 and inserting into the clutch drum 413 aligning the spring guides 419 and securing the drum rear closure 423 to the drum 413 with the snap ring 434.

Oil delivery sleeve oil control rings 429 are then installed on the oil delivery sleeve 428, followed by the intermediate thrust washer 430. The oil delivery sleeve 428 is then inserted into the drum rear closure 423. The assembly is placed into the case in the case web properly aligning the oil delivery sleeve dowel 413. The oil delivery sleeve bearing cap 432 is installed into the case 410 over the oil delivery sleeve 423 and secured with the bearing cap cap screws 433. This is followed by installing the front radial bearing 406 in the case front closure 407 followed by the case front bearing seal housing 404 and oil seal front 403 then secured to the case front closure 407 with fasteners 405.

The front thrust washer 409 is placed onto the clutch drum front closure 408 followed by installing the case front closure 407 onto the drum front closure 408 and securing to the case 410 with socket head cap screws (not sown in Figure). The secondary engine adaptor 402 is then fitted to the drum front closure 408 spline.

This is followed by installation of the fully assembled oil pump consisting of the oil pump case 436, oil pump drive gear 437, oil pump driven gear 438, oil pump drive gear inboard bushing 439, drive gear outboard bushing 440, oil pump driven gear bushing 441, oil pump driven gear shaft 442, oil pump driven gear key 497, followed by the oil pump case cover 443 secured by the machine screws 444. The assembled oil pump is fitted on to the drive spline 425 and secured to the case 410 web with four cap screws (not shown). The rear thrust washer 449 is then placed onto the drive spline 425.

The rear radial bearing 451 is placed into the case rear closure 450 followed by the case rear bearing seal housing 452 and oil seal rear 455 and secured to the case rear closure 450 by the machine screws 453. The case rear closure 450 is then slid over the drive spline 425 and secured to the case 410 with the cap screws 454. The primary engine crankshaft adaptor 456 is then fitted to the drive spline 425. The oil pump suction tube 446 is inserted into the oil pump case 436 followed by placing the oil pump suction strainer 445 over the tube 446. The oil sump 460 complete with oil sump drain plug 461 is secured to the case 410, case front closure 407 and case rear closure 450 with the cap screws 462.

Figure 5:
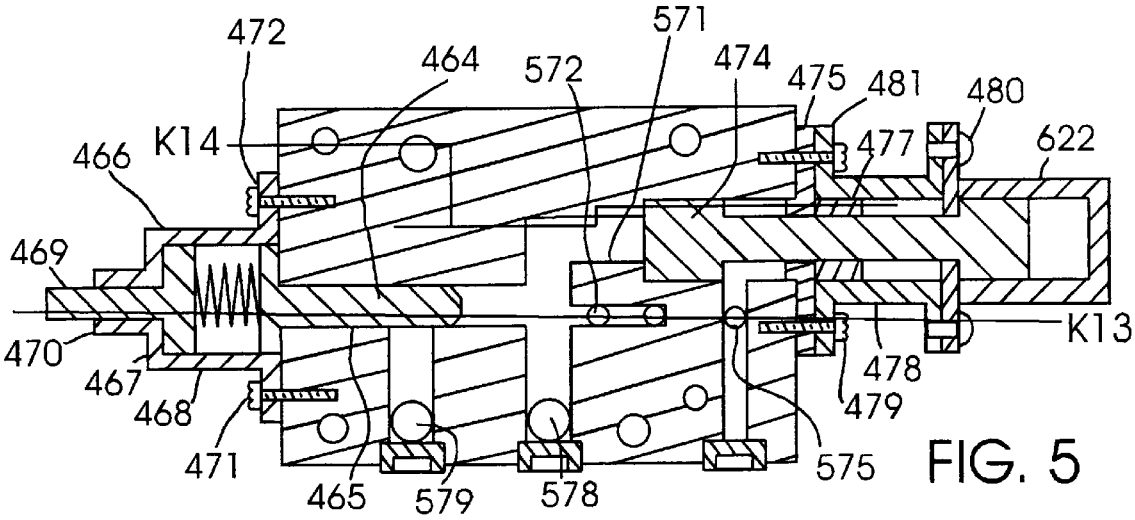
FIG. 5 is a diagram of the assembledpressure control valve cross-sectional view.
Figure 6:
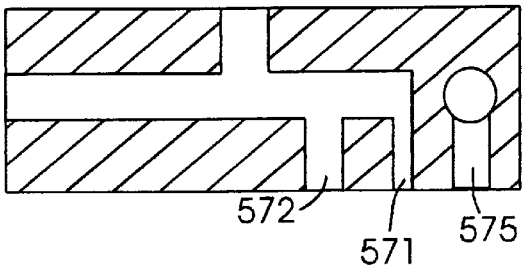
FIG. 6 and FIG. 7 are other cross-sectional views of the pressure control valve.
Figure 7:
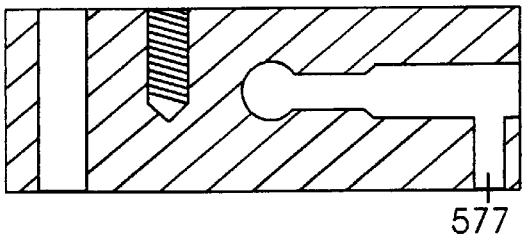
Figure 10:
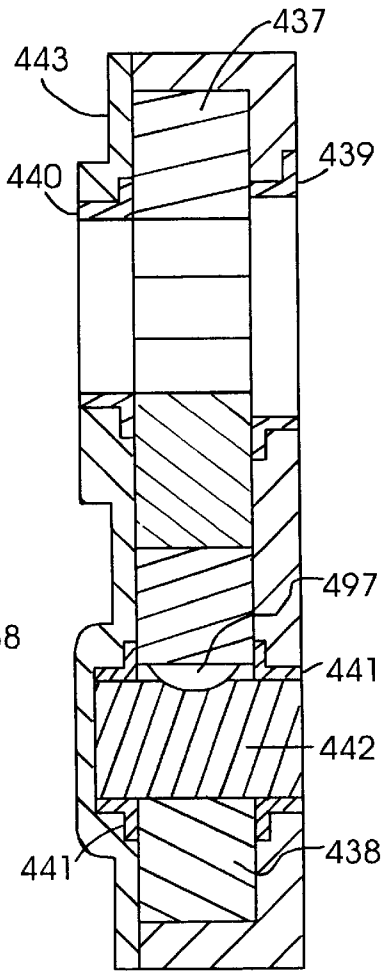
FIGS. 8, 9 and 10 are diagrams of various cross-sections of the hydraulic pump.

The oil pump discharge tube 447 is inserted through the valve body oil pressure inlet port 578 provided in the case 410 into the oil pump case 436 discharge port then the assembled pressure control valve body 463, FIG. 5, consisting of the relief valve piston 464, "O" ring 465, relief valve spring 466, relief valve spring compression disc 467, relief valve spring housing 468, adjusting screw 469, adjusting screw jam nut 470, studs 471, hex nuts 472 clutch actuator piston 474, actuator piston closure 475, closure "O" ring 476, piston actuator coupling 477, piston actuator spool 478, studs 479, hex nuts 481, CSVV clutch actuator piston solenoid 622 and machine screws 480 is secured to the top of the case 410 with the cap screws 473, the front bearing lubrication oil valve port 571, FIG. 6, rotating members lubrication oil valve port oil 572, hydraulic pressure vent port 575, hydraulic pressure vent port 577, (shown in FIG. 7) valve body oil pressure inlet port 578 and valve body relief valve discharge port 579 align with the respective passages in the case 410.

The accumulator FIG. 4 consists of the accumulator body 482, piston guide plate 483, guide plate bushing 484, not accumulator piston 485, accumulator piston oil control ring 486, spring lower disc 487, horseshoe lock 488, accumulator spring 489, spring upper disc 490, spring housing 491, adjusting screw 492, adjusting screw jam nut 493, cap screws 494, hex nuts 495 and is secured to the top of the valve body 463 with the cap screws 496.

The number, size, horsepower, and torque of the engines selected is only limited by the structural integrity designed into a CSVV coupling for a specific application. Since the basic operation of the internal combustion engine is well known, the components identified will be referred to as they interrelate with the invention.

The primary engine consists of at least one combustion chamber connected to a crankshaft and a flywheel connected to the output end of the crankshaft. Also optionally fitted to the crankshaft 104 is an auxiliary drive pulley 112 fitted with an auxiliary belt 113 connected to a coolant pump pulley 114 secured to a coolant pump 115.

The throttle linkage 106 is connected to the throttle plate 107 located in the intake manifold 105. The manifold 105 is secured to the cylinder head 132. The oil pump screen 129 and oil pump 130 are located in the primary engine oil sump 128 that is fitted to the bottom of the engine 100.

The secondary engine 200 crankshaft 204 output end is connected to the CSVV coupling 400 crankshaft adaptor 402. The timing pulley/sprocket 211 is fitted to the crankshaft along with the harmonic balancer 212.

A stepper motor throttle linkage 206 is connected to the throttle plate 207 located within the intake manifold 205. The manifold 205 is secured to the cylinder head 232.

In the illustrated embodiment of the invention certain mechanical items are common to the primary engine 100 and the secondary engine 200 and provide a common cooling system and lubrication system. These common systems insure a constant operating temperature for both the primary and secondary engines. The systems allow the operating primary engine 100 to preheat the secondary engine 200 and also allows the primary engine 100 to provide oil pressure to the secondary engine 200 prior to the operation of the secondary engine.

These common mechanical items are a radiator 301, a coolant return means 302 from the secondary engine to the primary engine, a coolant pump discharge to the secondary engine 304, a secondary engine coolant discharge to the radiator 305, a primary engine oil discharge to the secondary engine 306 and an engine oil sump level equalizing tube 307.

One embodiment of the control system of the invention comprises a computer 608 and means for monitoring critical input signals. These input signals may include:

- signals from a tachometer means from the secondary engine ignition coil 607,
- signals from a tachometer means from the primary engine coil 611,
- signals from a secondary engine coolant temperature sensor 623,
- signals from a secondary engine oil temperature sensor 624,
- signals from a secondary engine crankshaft position sensor 625,
- signals from a primary engine crankshaft position sensor 626,
- signals from a CSVV coupling oil pressure sensor 627,
- signals from a primary engine coolant sensor 628,
- signals from a secondary engine vacuum sensor 629,
- signals from a primary engine oil temperature sensor 630, signals from a primary engine throttle position sensor 636, signals from an atmospheric pressure sensor 618, and signals from an ambient temperature sensor 619.

Computer output signals are to a relay 614 which provides initial voltage to a fuel valve solenoid 615. This fuel valve solenoid controls the supply of fuel to the secondary engine 200. Output signals are also sent to relay 606 in order to provide initial voltage to the secondary engine ignition coil 607, to relay 612 to provide initial voltage to a stepper motor 620, and to relay 613 to provide initial voltage to the CSVV dutch actuator piston solenoid 622.

An engine selector module 609 is interfaced with the computer 608. The engine selector module comprises a primary engine selector push-button 633 and primary/secondary engine selector push-button 634. A dock 610 located in the computer 608 is interlocked with the selector button 633, 634 circuit.

The initial electrical circuit comprises a battery 600, a three position key switch 601, a relay 602, a starter motor 603, initial power terminal block 604 which has a lead to the step down transformer 635 to the computer 608. Initial voltage from the terminal block 604 is supplied to a relay 613 providing initial voltage to the CSVV clutch actuator piston solenoid 622, to a relay 612 providing initial voltage to the stepper motor 620, to the primary engine ignition coil 611, to a relay 606 providing initial voltage to the secondary engine ignition coil 607, to the fuel pump 605 and to a relay 614 providing initial voltage to the secondary engine fuel valve solenoid 615.

The invention and related process is positioned between a minimum of two internal combustion engines affecting the operation of the sum of the engines relative to fuel economy and reduced hydrocarbon and nitrogen oxide emissions. In one embodiment of the invention, the constant speed variable volume coupling is employed to optimize the efficiency of a plurality of internal combustion engines by using the primary engine to provide optimal starting conditions of the secondary engine. The primary engine heat generated by the combination of internal combustion and friction is transferred by the coolant medium and common lubrication system to the secondary engine ensuring optimal lubrication and operating temperature conditions for start-up of the secondary engine. Furthermore, the secondary engine would be started only under road conditions that require increased power. As an added advantage the crankshaft and combustion chamber components of the secondary engine would not be moving unless they were employed to deliver additional horsepower/torque.

OPERATION OF INVENTION

Figure 2:
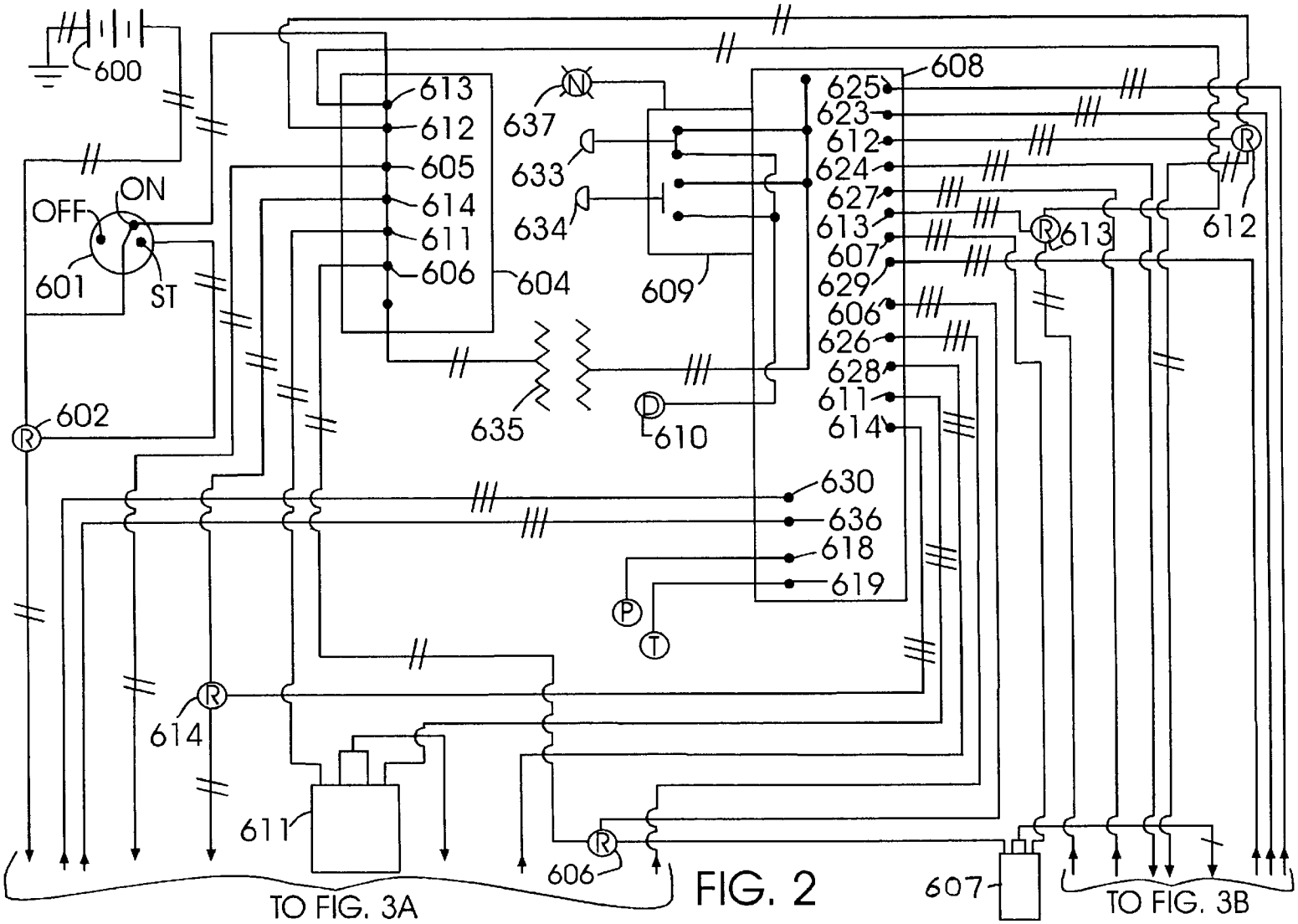
FIG. 2 is a diagram of the electrical controls for the claimed process.

With reference to FIGS. 2, 3*a* and 3*b* and assuming a cold start condition the three position key switch 601 is placed in the start position initiating the following simultaneous events. Initial voltage from the battery 600 energizes the initial power terminal block 604 providing initial voltage to relay 613, relay 612, the primary engine ignition coil 611, relay 606, the fuel pump 605, relay 614, step down transformer 635, serving computer 608, and dosing the contacts in relay 602 energizing the starter motor 603.

The starter motor 603 engages the flywheel 103 turning the crankshaft 104 this causes piston assemblies 116 and 123 to reciprocate in their respective cylinders 101 and 102, the timing pulley/sprocket 111 rotates driving the camshaft drive belt/chain 110 turning the camshaft 108 controlling the opening and closing of the intake valves 120, 127 and exhaust valves 119, 126.

As the cylinder No. 1 piston assembly 116 enters the intake stroke starting to descend the cylinder No. 1 intake valve 120 opens allowing air to be drawn past the throttle plate 107 through the intake manifold 105 into the cylinder 101 as the No. 1 cylinder fuel injector 118 discharges a predetermined amount of gasoline into cylinder 101. As the crankshaft 104 rotates the No. 2 cylinder piston assembly 123 starts into an exhaust stroke moving upward forcing spent gases through the open No. 2 cylinder exhaust valve 126 and directed through the exhaust system, not shown, to the atmosphere. The No. 2 cylinder piston assembly 123 reaches the top of its exhaust stroke as the No. 1 cylinder piston assembly 116 has descended to the lowest point of its intake stroke. The direction of travel is then reversed; whereas, the rotating camshaft doses the No. 2 cylinder exhaust valve 126 and opens intake valve 127 allowing air to enter from the intake manifold 105 and actuation of the No. 2 cylinder fuel injector 125 to charge cylinder No. 2 102.

Meanwhile, cylinder No. 1 piston assembly 116 enters its compression cycle moving upward compressing the fuel mixture contained in cylinder No. 1 101. As No. 1 piston assembly 116 reaches the top of the compression stroke the distributor 616 receiving ignition voltage from the primary engine ignition coil 611 sends ignition voltage through the wire connected to cylinder No. 1 spark plug 117 shooting a spark across the spark plug 117 air gap causing an explosion to occur, the expanding gases drive the piston assembly 116 down rotating the crankshaft 104. This is the power stroke and it is during this event that undesirable wall quenching occurs.

As the cylinder No. 1 piston assembly 116 is driven down rotating the crankshaft 104 the cylinder No. 2 intake valve 127 doses and the cylinder No. 2 piston assembly 123 moves upward on its compression stroke. Thereafter, the four strokes (1) intake, (2) compression, (3) power and (4) exhaust continue alternately and the engine 100 is started and running. The three position key switch 601 is then placed in the run position and the relay 602 contacts open disengaging and de-energizing the starter motor 603.

Digressing, it can be understood that since the four strokes constitute one complete cycle or round of action it can be realized that the whole cycle for one cylinder requires two revolutions of the crankshaft. Therefore, a single cylinder engine operating at 1000 revolutions per minute (RPM) produces 500 power strokes per minute and carried further an eight cylinder engine operating at 1000 RPM would produce 4000 power strokes per minute. Therefore, in reducing air emissions due to wall quenching it is necessary to reduce the number of power strokes per revolutions per minute of an engine and to increase the temperature of the cylinder walls to the acceptable engine operating conditions as early as possible.

With the crankshaft rotating, the auxiliary drive pulley 112 is turning transmitting the motion by means of the auxiliary drive belt 113 to the coolant pump pulley 114 operating the coolant pump 115 recirculating coolant from the primary engine 100 through the coolant pump discharge to the secondary engine 304, coolant then passes through the secondary engine coolant jacket 231 transferring heat to this non-operating engine 200 to the secondary engine coolant discharge to radiator 305, the radiator 301 affords the coolant retention time required at ambient temperature for cooling. The coolant is then drawn through the coolant return to the primary engine 302 line to the primary engine 100 circulated through the coolant jacket 131 removing heat from the primary engine 100 and then through the coolant supply to pump 303 continuing the heat transfer recirculation.

Figure 9:
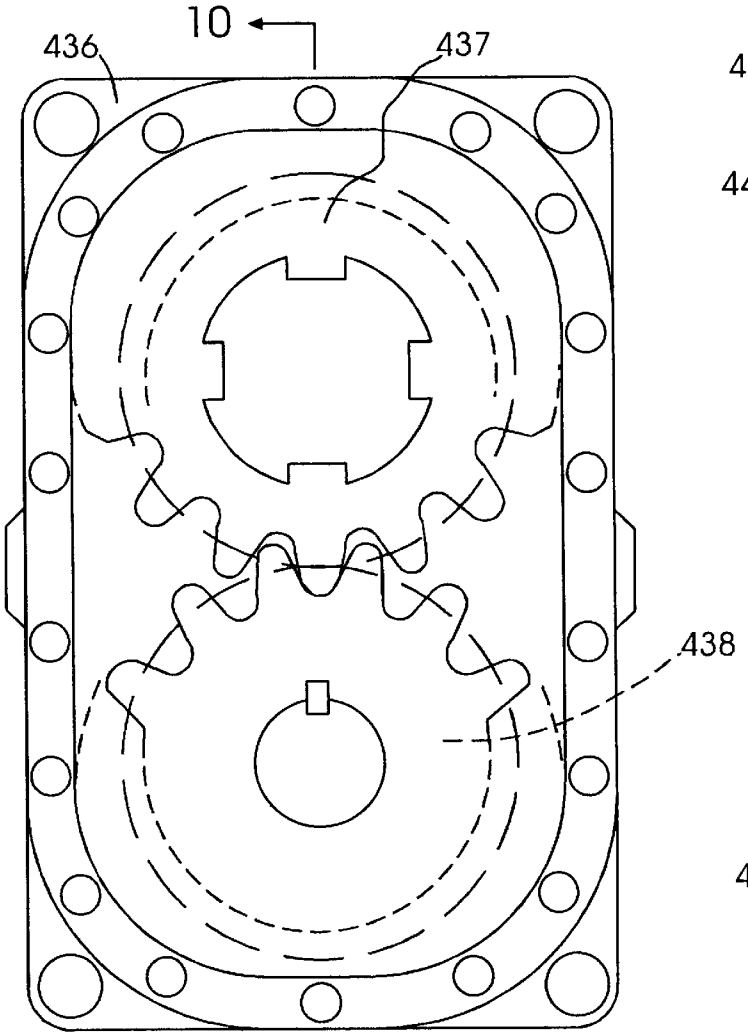
Figure 8:
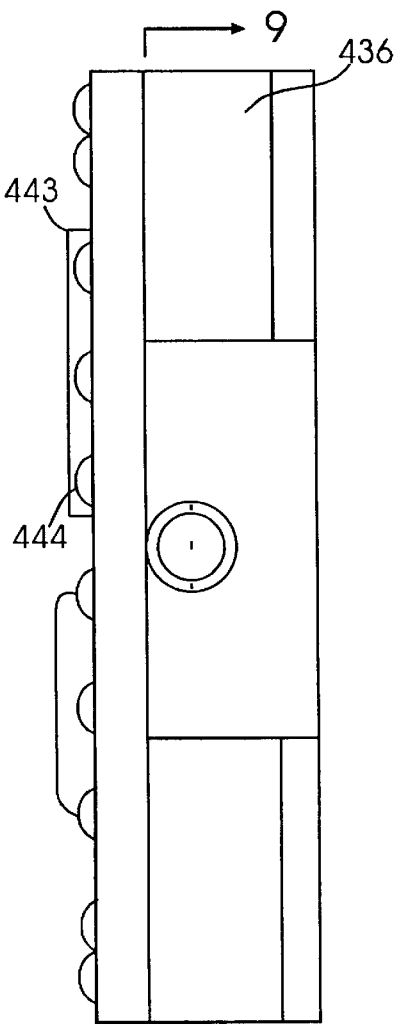

The engine oil pump 130 driven off of the primary engine is located in the oil sump 128. The oil pump 130 draws engine lubricating oil from the oil sump 128 through the oil pump screen 129. Discharge is through the primary engine 100 providing lubrication to the various moving parts then continuing through the primary engine oil discharge to secondary engine 306 line providing lubrication to the various secondary engine 200 moving parts. The oil is then collected in the secondary engine oil sump 228 and returned to the primary engine oil sump 128 through the engine oil sump level equalizing tube 307 for continued recirculation.

continuing with the rotation of the crankshaft 104, the primary engine crankshaft adaptor as shown in FIG. 3*a* (Harmonic balancer) coupling half 458 secured in turn to the primary engine crankshaft adaptor spacer 457 to the primary engine crankshaft adaptor 457 transmits the rotary motion to the primary engine drive spline 425. The case rear bearing seal housing 452 contains the oil seal rear 455 to prevent oil leakage and holds the rear radial bearing 451 required to control drive spline 425 radial motion being secured to the case rear closure 450 with the machine screws 453. The oil pump drive gear 437 rotates in the oil pump case 436 (see FIGS. 8 and 9). Radial forces are controlled by the oil pump drive gear outboard bushing 440, FIG. 8, located in the oil pump case cover 443 and inboard bushing 439. Rotation of the drive spline 425 turns the oil pump drive gear 437 driving the oil pump driven gear 438 mounted on the oil pump driven gear shaft 442 with radial forces contained by the oil pump driven gear bushings 441 located in the pump case 436 and oil pump case cover 443.

The drive spline 425 extends through the oil delivery sleeve 428 and meshes with the clutch discs 416 and into the front closure bushing 415 with the clutch discs 416 rotating with the crankshaft 104.

The rotating drive spline 425 turns the oil pump drive gear 437 in turn driving the oil pump driven gear 438 causing oil within the oil sump 460 to be drawn up through the oil pump suction strainer 445 and oil pump case 436 and into the oil pump discharge tube 447 at a high volume, high pressure into the valve body oil pressure inlet port 578.

As the oil enters the valve body 463 the chambers are flooded and pressurized storing the hydraulic energy in the accumulator body 482 raising the accumulator piston 485, oil leakage past the piston 485 is prevented by the accumulator piston oil control ring 486, lateral movement is controlled by the guide plate bushing 484 secured in the piston guide plate 483. Static height of the piston is controlled by threading the spring lower disc 487 onto the threaded piston 485 stem and securing with the horseshoe lock 488. As the piston 485 rises the accumulator spring 489 with lateral movement contained by the spring housing 491 and spring upper disc 490 compresses. The hydraulic energy stored in the accumulator body is predetermined by spring 489 selection and final adjustment of the adjusting screw 492 bearing on the upper disc 490 and secured with the jam nut 493.

Figure 13:
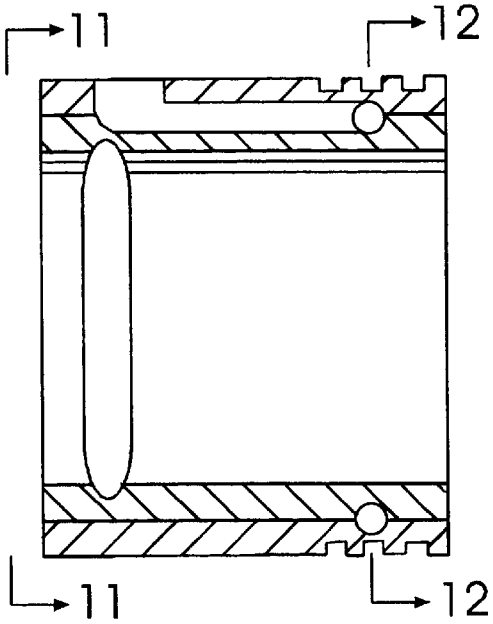
FIGS. 11, 12, and 13 are diagrams of various views and cross-sections of the oil delivery sleeve.
Figure 12:
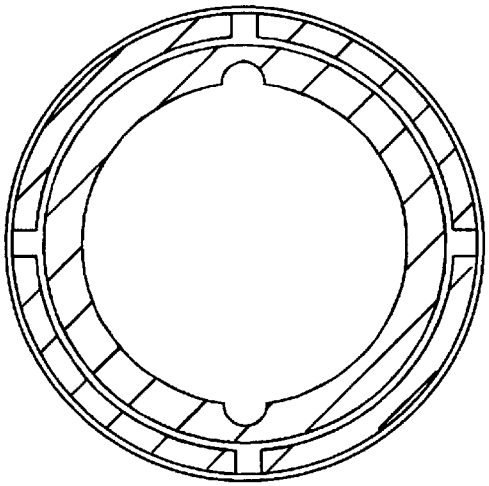
Figure 11:
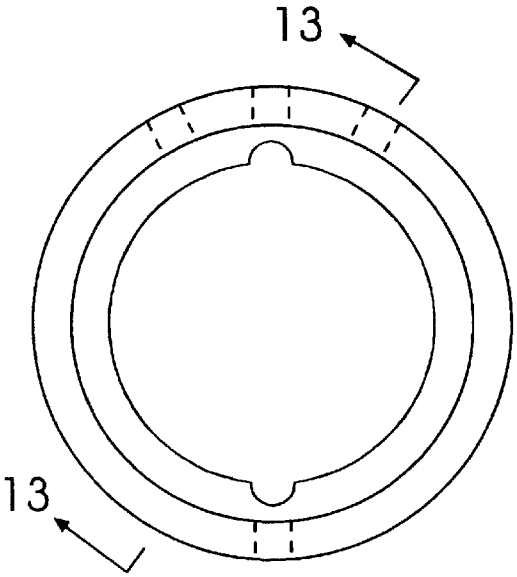

As operating pressure is established, oil is discharged through the front bearing lubrication oil valve port 571 into the front bearing lubrication oil passage 570 located in the case 410 and case front closure 407 providing lubrication oil to the front bearing 406 and front thrust washer 409. Oil forced through the rotating members lubrication oil valve port 572 enters the rotating members lubrication passage 573 provided in the case 410 directing the oil into the oil delivery sleeve 428, see FIGS. 11, 12 and 13, lubricating the oil delivery sleeve 428 bearing surfaces in contact with the primary engine drive spline 425 and the clutch drum rear closure thrust washer 426. The primary engine drive spline lubrication oil passage 574 is then pressurized delivering lubrication to the oil pump drive gear outboard bushing 440, oil pump drive gear inboard bushing 439, clutch discs 416/clutch plates 417 assembly and the front closure bushing 415.

As the hydraulic system stabilizes over pressure is relieved as the pressure is applied to the face of the relief valve piston 464 compressing the relief valve spring 466 bearing on the relief valve spring compression disc 467 contained in the relief valve spring housing 468. Spring load is predetermined, minor adjustments are accomplished by turning the adjusting screw 469 and securing with the jam nut 470. As the relief valve piston 464 compresses the spring 466 the port 579 is exposed, excess hydraulic energy oil enters this port for return to the case 410 providing splash lubrication to the rear thrust washer 449 and rear radial bearing 451 draining to the sump 460.

The primary engine system is now operational with maximum primary engine 100 horsepower available at the flywheel 103 allowing the vehicle to be operated under low to medium load conditions. Input signals received by the computer 608 are from the clock 610 started as the primary engine 100 operation is established. Purpose for the dock 610 is to provide a minimum warm-up period as may be required by federal regulation requirements relative to reduced exhaust emissions and to meet fuel efficiency standards. Secondly, in geographical areas where severe cold weather would impede the warm-up period and create unsafe driving conditions with primary power a minimum warm-up period would be established in the computer for a time period determined on input from the ambient temperature sensor 619. Continuing input signals are received from the primary engine ignition coil 611 tachometer circuit, secondary engine oil temperature sensor 623, secondary engine oil temperature sensor 624, primary engine crankshaft position sensor 626, CSVV coupling oil pressure sensor 627, primary engine oil temperature sensor 630, primary engine throttle position sensor 618 and the ambient temperature sensor 619. The computer 608 continually monitors all input signals.

The secondary engine 200 start is contingent on satisfying the following conditions:

First: The primary engine coolant temperature sensor 628 and the secondary engine coolant temperature sensor 623 have equalized.

Second: The primary engine oil temperature, sensor 630 and secondary engine oil temperature sensor 624 have equalized.

Third: Primary engine speed (RPM) primary ignition coil 611 tachometer circuit input is sufficient as not to stall the primary engine 100.

Fourth: The dock 610 period as been met

Fifth: Oil pressure is established in the CSVV 400, oil pressure sensor 627.

When the above criteria is confirmed, the announciator 637 located in the engine selector module 609 will register informing the driver the secondary engine 200 can be placed in the start mode.

Depressing the primary and secondary engine selector push button 634 closing the normally open contacts initiates output signals to relay 614 energizing the fuel valve solenoid 615 opening the valve providing fuel flow to the cylinder No. 3 fuel injector 218 and to cylinder No. 4 fuel injector 225, to relay 606 providing initial voltage to the secondary engine ignition coil 607, to relay 612 providing initial voltage to the stepper motor 620 and to relay 613 closing the CSVV clutch actuator piston solenoid 622 normally open contacts retracting the dutch actuator piston 474. This directs hydraulic pressure into the hydraulic pressure valve port 575 into the hydraulic pressure passage 576 provided in the case 410 into the oil delivery sleeve 428. The hydraulic pressure is then directed through the passage provided in the oil delivery sleeve 428 exiting at ports provided, located between the oil delivery sleeve oil control rings 429 and entering the ports provided in the clutch drum rear closure 423 FIG. 4 and directed to the space behind the annular piston 421. The annular piston 421 and clutch drum rear closure 423 are fitted with the annular piston seal "O" ring 422 and dutch drum piston seal "O" ring 424 to prevent hydraulic fluid leakage. Force developed as hydraulic fluid fills the annular space, extends the annular piston 421 compressing the multiple disc dutch, consisting of alternately placed clutch discs 416, clutch plates 417 return springs 420, free to slide over the clutch drum annular piston return spring guides 419.

With the multiple disc clutch transferring the drive spline 425 rotation to the clutch drum 413, causes the clutch drum front closure 408 to rotate driving the secondary engine crankshaft adaptor 402 secured to the secondary engine crankshaft 204 causing reciprocation action of the No. 3 piston assembly 216, No. 4 piston assembly 223, rotation of timing pulley/sprocket 211, driving the camshaft drive belt/chain 210, driving the camshaft pulley/sprocket 209 causing the camshaft 208 to rotate opening and dosing the cylinder No. 3 intake valve 220, cylinder No. 3 exhaust valve 219 cylinder No. 4 intake valve 227 and cylinder No. 4 exhaust valve 226.

The energized secondary engine ignition coil 607 provides ignition voltage to the secondary engine distributor 617 which alternately sends ignition voltage through the connecting wires to the cylinder No. 3 spark plug 217 and cylinder No. 4 spark plug 224. With the fuel valve 615 open, fuel is provided to the cylinder No. 3 fuel injector 218 and cylinder No. 4 fuel injector 225 upon demand.

With all conditions established the four strokes; intake, compression, ignition and exhaust commence allowing the secondary engine to start. As the secondary engine 200 starts, the vacuum sensor 629 informs the computer 608, the computer evaluates this signal with the atmospheric pressure sensor 618 signal confirming the negative pressure, computer 608 logic then signals relay 613 contacts to open de-energizing the CSVV dutch actuator piston solenoid 622 causing the dutch actuator piston 474 to shift closing off the hydraulic pressure supply to hydraulic pressure valve port 575. Hydraulic energy contained in hydraulic pressure passage 576 is directed through hydraulic pressure vent port 577 to the sump 460 provided in the case. With the hydraulic energy removed from the clutch drum rear closure 423 the clutch drum annular piston return springs 420 expand returning the annular piston 421 into the clutch drum rear closure 423 disengaging the multiple disc clutch.

As the multiple disc clutch is disengaged the computer 608 receives and processes input signals from the secondary engine crankshaft position sensor 625 and the secondary engine ignition coil 607 tachometer circuit. Computer 608 then signals relay 612 to energize the stepper motor 620 modulating the throttle linkage 206 to increase or decrease the throttle plate 207 opening to synchronize the primary engine 100 speed (RPM) and secondary engine 200 speed (RPM) and crankshaft 104 and 204 position. When the crankshaft 104 and 204 positions attain synchronization the primary engine throttle position sensor 636 input signal to computer 608 takes control of the stepper motor 620 insuring simultaneous throttle control.

With synchronization established the computer 608 instructs relay 613 to energize the CSVV clutch actuator piston solenoid 622 normally open contacts to close retracting the clutch actuator piston 474 closing the hydraulic pressure vent port 577 directing the hydraulic energy to the hydraulic pressure valve port 575, hydraulic pressure passage 576, oil delivery sleeve 428 into the clutch drum rear closure 423 annular space causing the annular piston 421 to extend compressing the clutch discs 416 and clutch plates 417 completing the coupling of the primary engine 100 and secondary engine 200 providing full available multiengine, multicylinder horsepower at the flywheel 103.

As road load conditions decrease, fully available horsepower is not required, i.e. city driving, idling, heavy traffic, highway cruising. The driver, by depressing the primary engine selector pushbutton 633 opens the primary/secondary engine selector pushbutton 634 contacts disengaging the CSVV coupling 400 multiple disc clutch by instructing relay 613 to de-energize the CSVV solenoid 622 and shutting the secondary engine down (off) by instructing relay 614 to de-energize the fuel valve 615 solenoid stopping fuel to the secondary engine fuel injectors 218, 225, instructs relay 606 contacts to open interrupting the secondary engine 200 ignition voltage to distributor 617, instructs relay 612 contacts to open de-energizing the stepper motor 620. The vehicle is now operating with primary engine power.

Regardless of mode selection, when placing the three position key switch 601 in the "off" position, the primary and secondary engine selector push button 634 contacts will move to the normally open position and the primary engine selector push button 633 contacts will return to the normally closed position. This returns the system to the primary engine mode of operation for the next start-up.

As can be understood and visualized by the preceding description of my invention the internal combustion engine constant speed variable, volume coupling and operating process achieves the objects and advantages cited earlier.

Of course other control mechanisms could be employed to engage the use of the secondary engine. A computer controlled mechanism could take into account a number of inputs including road grade, speed, accelerator position, gear selection, or other factors, such as fuel tank level (in case only an economical power supply was specified under tank load conditions). The control mechanism for engaging the constant speed variable volume coupling can be controlled by either an open control loop (a loop that may be initiated by the driver) or a closed loop system which is controlled by load conditions as sensed by a computer.

In any event, the present invention provides an internal combustion powerplant that employs only as many operating cylinders as required in a particular situation. This is accomplished by providing a clutch coupling means between units of internal combustion chambers, where said clutch coupling means is coupled to the crankshaft of each of the internal combustion chamber units. The internal combustion chamber units may be single internal combustion chambers, i.e. single cylinders, or multiple cylinder units. In application the invention will have one primary internal combustion chamber unit which starts the engine, provides initial power, and also provides lubrication of the secondary engine and transfers heat to the secondary engine. Further advantages are achieved by providing the minimum of effective power strokes of the power unit, since the combustion chambers will be under optimal loads, and if the secondary combustion chambers are not needed they will not be employed, or linked to the primary chambers, and will not move.

What is claimed is:

1. A constant speed variable volume coupling for vehicular applications which is comprised of:

a clutch-type coupling which may be placed between two engines that is capable of allowing the two coupled engines to operate at different rotational speeds providing unitized operation of said engines;

a computer with input means for monitoring operating parameters of a first and a second engine coupled to said constant speed variable volume coupling so that operation of said second engine occurs only when optimal startup conditions have been obtained including coolant temperature and oil pressure and only when road conditions require additional power;

and, engagement means for engaging said clutch-type coupling that is activated by said computer.

2. The constant speed variable volume coupling of claim 1 which further comprises:

means for electronic control of said clutch-type coupling of said engines.

3. A method for optimizing the efficiency of an internal combustion engined vehicle using a constant speed variable volume coupling comprised of a clutch-type coupling which may be placed between two engines that is capable of allowing the two coupled engines to operate at different rotational speeds providing unitized operation of said engines; a computer with input and output means for monitoring operating parameters of a first and a second engine coupled to said constant speed variable volume coupling so that operation of said second engine occurs only when optimal startup conditions have been obtained including coolant temperature and oil pressure and only when road conditions require additional power; and, engagement means for engaging said clutch-type coupling that is activated by said computer wherein said method comprises the steps of:

connecting said coupling to a primary internal combustion engine and to a secondary internal combustion engine, utilizing the crankshaft rotating force of the primary engine to start a succeeding engine by engaging the hydraulic operated clutching mechanism and disengaging said clutch upon a signal to the computer allowing the specific succeeding engine to attain synchronization with the previous engine and then on an input signal to the computer re-engaging the clutching mechanism permitting operation of multiple engines as a single unit.

4. A method according to claim 3 wherein the synchronization of the crankshafts of the operating primary and secondary engines is accomplished by use of a primary engine crankshaft position sensor; and a secondary engine crankshaft position sensor;

wherein said primary engine crankshaft position sensor and secondary engine crankshaft position sensor provide input signals to a computer which continually monitors the primary engine crankshaft position and secondary engine crankshaft position and provides corrections by means of output signals to the engine throttle controls.

5. A method according to claim 4 of controlling succeeding (RPM) speed to maintain unitized operation by means of a throttle position sensor operating off of the primary engine conventional throttle linkage providing an input signal to the computer for matching throttle position with the primary and succeeding engines tachometer input signals for final speed control of succeeding engines by use of a stepper motor.

6. The method of claim 3 wherein said method provides for the optimization of efficiency of fuel economy and reduction of emission of hydrocarbons and oxides of nitrogen and wherein said input and output means includes means for engagement are further dependent upon selection from an operator of the vehicle.

* * * * *